United States Patent [19]

O'Brien et al.

[11] 4,386,335

[45] May 31, 1983

[54] ELECTRIC PLUG TYPE FUSE

[75] Inventors: Terry R. O'Brien, Mississauga; Kurt W. Lechner, Toronto, both of Canada

[73] Assignee: Gould Inc., Electric Fuse Div., Newburyport, Mass.

[21] Appl. No.: 343,617

[22] Filed: Jan. 28, 1982

[30] Foreign Application Priority Data

Mar. 4, 1981 [CA] Canada ..... 372297

[51] Int. Cl.[3] ..... H01H 85/16

[52] U.S. Cl. ..... 337/261; 337/260

[58] Field of Search ..... 337/255, 260, 261, 270, 337/271

[56] References Cited

U.S. PATENT DOCUMENTS 2,527,160 10/1950 Taylor ..... 337/261

2,789,182 4/1957 Baenziger ..... 337/261 X

*Primary Examiner*—George Harris

*Attorney, Agent, or Firm*—Frederick A. Goettel, Jr.

[57] ABSTRACT

An electric plug type fuse. The hollow glass body thereof contains a strip-like spring conductively connected to the bottom contact in the insulating tip of the fuse. Said spring is arcuate and has a center of curvature situated at the side of the spring where the longitudinal axis of the glass body is located. A solder joint preferable of a eutectic metal connects the end of the spring remote from the bottom contact to a fusible element capable of interrupting short-circuit-like currents, i.e. a ribbon type fusible element having at least one point of reduced cross-section. The aforementioned spring and the fusible element enclose an angle of approximately 90 deg. and the end of the fusible element remote from said spring is conductively connected to a screw shell. The spring puts the fusible element under tension and is released from it when the solder joint connecting both parts melts.

8 Claims, 5 Drawing Figures

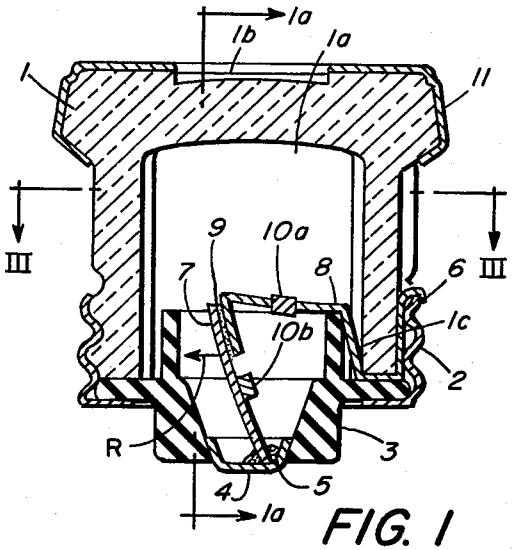
FIG. 1
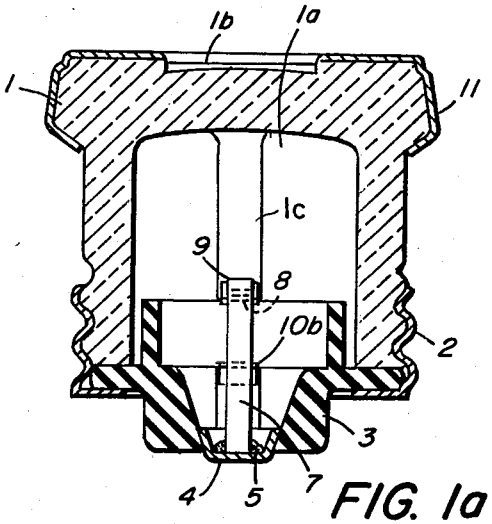
FIG. 1a
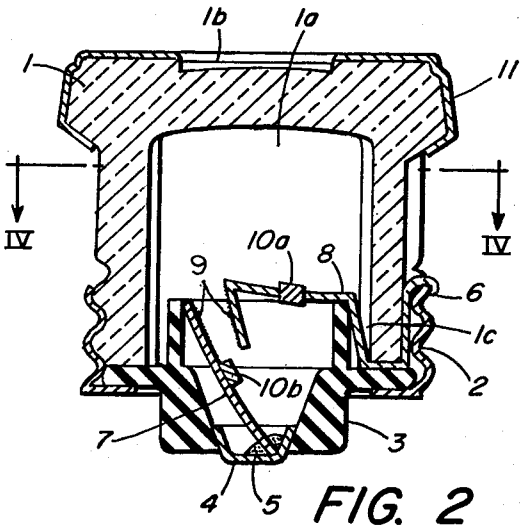
FIG. 2
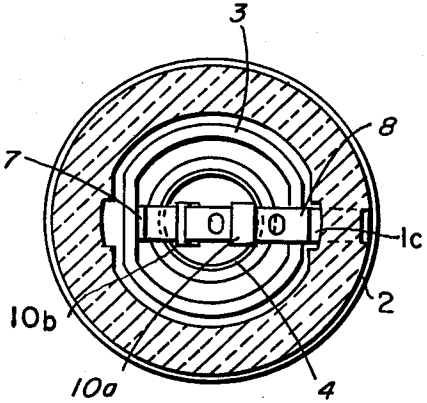
FIG. 3
FIG. 4

ELECTRIC PLUG TYPE FUSE

BACKGROUND OF THE INVENTION

This invention relates to electric plug type fuses. Such fuses are mass-produced, low cost items, and each additional manufacturing step and/or each additional part is, therefore, of critical importance to the acceptance of any plug fuse design. It is, therefore, the prime object of this invention, to provide electric plug type fuses which are simple to manufacture, include a minimum of parts, and are more cost-effective than prior art plug fuse designs.

A more specific object of this invention is to provide cost-effective electric plug type fuses having a spring-biased solder joint for interrupting relatively small overload currents of excessive duration wherein the spring bias of the solder joint is established by the spring supporting the solder joint rather than by additional spring means.

Other objects of the invention and advantages thereof will become more apparent as this specification proceeds.

SUMMARY OF THE INVENTION

The present invention relates to electric plug type fuses including a substantially cylindrical hollow glass body defining a cavity and being screw-threaded on the outer surface thereof, a contact-button-support of electric insulating material of which one end projects into said cavity and the other end projects in opposite direction away from said cavity to the outside thereof, a contact button on the axially outer end of said contact-button-support, a metal shell overlapping said contact-button-support and having screw-threads mating with the screw-threads on said glass body.

The principal novel features according to this invention are a strip-like arcuate spring conductively connected to said contact button, said spring having a center of curvature situated at the side thereof where the longitudinal axis of said glass body is located. The fuse further comprises a solder joint on the end of said spring remote from said contact button joining said spring to a fusible element capable of interrupting short-circuit-like currents. Said spring and said fusible element enclose an angle of approximately 90 deg. and the end of said fusible element remote from said spring is conductively connected to said screw shell.

BRIEF DESCRIPTION OF THE DRAWINGS

FIG. 1 is a vertical section through a fuse according to the present invention in the circuit closed position thereof;

FIG. 1*a* is a section along 1*a*—1*a* of FIG. 1;

FIG. 2 is a section as that of FIG. 1 but showing the fuse after it has blown;

FIG. 3 is a section along III—III of FIG. 1; and

FIG. 4 is a section along IV—IV of FIG. 2.

DESCRIPTION OF PREFERRED EMBODIMENTS

In the drawings reference numeral 1 has been applied to indicate a substantially cylindrical hollow glass body. Glass body 1 defines a cavity 1*a*. Cavity 1*a* is plugged by a contact button support 3 of an electric insulating material such as, for instance a synthetic resin. One end of contact button support 3 projects into cavity 1*a* and the other end of contact button support 3 projects in opposite direction away from cavity 1*a* to the outside of contact button support 3. A contact button 4 of an electroconductive material is arranged in coaxial relation to and affixed to contact button support 3. A screw-threaded metal shell 2 mating with the screw-threads on said glass body 1 is affixed to the latter. Screw shell 2 overlaps the button support or insulating tip 3 and thus holds the latter firmly in position. A metal cap 1 may be crimped to the front end surface of glass body 1 on which indications such as voltage rating, current rating, etc. may be written. The end surface 1*b* of glass body 1 is lens-shaped to facilitate observation of whether or not the fuse has blown. Fusible means conductively interconnect contact button 4 and screw shell 2.

These fusible means will now be described in greater detail.

They include a strip-like arc-shaped spring 7 of which the lower end is affixed to, and conductively connected with, contact button 4. As shown in FIG. 1 the inherent spring bias of strip 7 of a spring alloy has a direction substantially transversely to the longitudinal axis of glass-body 1, as indicated by the arrow R. A solder joint 9 on the end of strip or spring 7 remote from contact button 4 connects strip or spring 7 to a fusible element 8. Said fusible element 8 has at least one point of reduced cross-section to adapt it to interrupt short-circuit-like currents. The end of fusible element 8 remote from solder joint 9 is conductively connected to screw shell 2. This may be achieved by embedding that end of the fusible element 8 in an internal groove 1*c* in glass body 1 and conductively connecting the end of fusible element 8 projecting beyond groove 1*c* to screw-shell 2. Fusible element 8 is preferably of copper.

The current path through the fuse, as long as it is intact, is as follows: Contact button 4, spring 7, solder joint 9, fuse link 8 and screw-shell 2.

When the fuse is subjected to a relatively moderate overload, solder joint 9 looses its holding power between spring 7 and fuse link 8 and spring 7 spans from right to left, as shown in FIG. 2, thereby interrupting the current path where the same was formed by solder joint 9.

On occurrence of major fault current fusible element 8 fuses and vaporizes, and this interrupts the current path at the point where fusible element 8 had been prior to the fusion and vaporization thereof.

To maintain the support 3 in position relative to glass body 1, these parts are provided with any desired kind of cooperating abutments (not shown), to preclude relative rotation of these parts about the longitudinal axis of glass body 1.

Part 7 is connected to contact button 4 by a high temperature solder, or a spot weld 5. This precludes fusion of conductive connection 5 prior to solder joint 9. Contact button 4 is wedged into insulating tip or button contact support 3. Insertion of insulating tip or button contact support 3 into glass body 1 causes spring 7 to be pulled toward the right, or toward the longitudinal axis of glass-body 1, thereby loading spring 7.

Operation of the fuse is achieved from two heat sources, internal and/or external. Internal heat is caused when a current higher than the rated current of the fuse is passed through parts 7, 9, 8. When the temperature reaches the melting point of solder 9, the latter turns into a liquid and the spring 7 snaps back towards the outside of the assembly.

External heat may be caused from many sources, e.g. poor contacts or poor wire termination in the fuse holder. When the heat inside the fuse reaches the melting temperature of solder 9, it turns to a liquid and the spring 7 snaps back toward the outside of the fuse, thus interrupting the current path through the latter.

As shown in FIG. 1, spring 7 is arcuate, the center of the arc being in the direction of the longitudinal axis of glass body 1 and beyond said longitudinal axis. When the fuse is assembled and spring 7 loaded, tension is applied evenly along spring 7. This prevents any permanent deformation of spring 7. When the eutectic solder 9 melts, spring 7 will return to its original position, i.e. the position it had prior to its loading, as shown in FIG. 2. If spring 7 were either straight, or bent opposite to the way shown in FIGS. 1 and 2, loading of spring 7 would not result in an even stress pattern and spring 7 would be deformed at its junction with solder joint 5. Under such conditions spring 7 would not return to its preloading position upon fusion of eutectic solder joint 9, thus restricting the width of the gap formed between spring 7 and fusible element 8.

It will be apparent from FIG. 1 that in the loaded condition of spring 7 its upper end is to one side and its lower end is to the other side of the longitudinal axis of glass body 2.

The joining of spring 7 and fusible element 8 is also an important feature of this invention. Conventional solder has a plastic state, whereas eutectic solder turns at a given temperature instantaneously from solid to liquid. This reduces the tension which spring 7 has to overcome when the latter snaps back to the unloaded position thereof shown in FIG. 2. This, in turn, greatly reduces the interrupting or arcing time, i.e. assures a quick positive opening of the circuit under interruption.

The fuse thus far described is a normal fuse. If time lag is desired a lag block 10*a* is affixed to spring 7, or a lag block 10*b* is affixed to fusible element 8, or lag blocks 10*a*, 10*b* are affixed to both parts. This may be done by welding, high temperature fusing solder, or in any other appropriate desired way. Lag blocks 10*a*, 10*b* absorb heat generated by spring 7 and fusible element 8 and thus slow down the temperature rise of eutectic alloy 9 so that it melts at a later time than required if lag blocks 10*a*, 10*b* were not present.

Under very high over-current conditions there is no time left for heat transfer from the points of reduced cross-section of fusible element 8 to eutectic solder joint 9. In such instance a circuit interrupting break is formed by fusion and vaporization of the metal of which fusible element 8 is made.

We claim as our invention:

1. An electric plug type fuse including a substantially cylindrical hollow glass body defining a cavity and being screw threaded on the outer surface thereof, a contact button support of an electric insulating material of which one end projects into said cavity and the other end projects in the opposite direction away from said cavity to the outside thereof, a contact button on the outer end of said contact-button-support, a metal shell overlapping said contact-button-support, said metal shell being screw threaded, and the screw threads thereof mating with the screw threads on said glass body, wherein the novel features include:

a. strip-like spring having one end thereof conductively connected to said contact button and the other end of said spring extending into said cavity defined by said glass body;

b. a fusible element capable of interrupting short-circuit-like currents, one end of said fusible element being conductively connected to said metal shell; and, c. a solder joint conductively joining the othe end of said fusible element to the other end of said strip-like spring said solder joint holding said strip-like spring in a deflected position where said spring serves to place said solder joint in tension, whereby; upon fusing of said fusible element or melting of said solder joint said springs resiliency will cause it to move away from said fusible element to a nonconducting position.

2. A plug-type fuse as specified in claim 1 wherein said solder joint is of a eutectic metal.

3. A plug-type fuse as specified in claim 1 wherein said spring supports a lag block.

4. A plug-type fuse as specified in claim 1 wherein said fusible element supports a lag block.

5. A plug-type fuse as specified in claim 1 wherein both said spring and said fusible element are each provided with a lag block.

6. An electric plug-type fuse including a substantially cylindrical hollow glass body defining a cavity and being screw-threaded on the outer surface thereof, a contact button support of an electric insulating material of which one end projects into said cavity and the other end projects in opposite direction away from said cavity to the outside thereof, a contact button on the outer end of said contact button support, a screw-threaded metal shell overlapping said contact button support, said metal shell being screw-threaded and the screw-threads thereof mating with said screw-threads on said glass body wherein the novel features include (a) a resilient arcuate strip of a spring alloy material having one end thereof conductively connected to said contact button, one end of said spring when loaded being situated to one side of the longitudinal axis of said glass body and the other end of said spring when loaded being situated to the other side of the longitudinal axis of said glass body to equalize the tension along said spring;

(b) a eutectic solder joint at the end of said spring remote from said contact button joining said spring to a fusible element having at least one point of reduced cross-sectional area; and (c) said spring when loaded and said fusible element enclosing an angle of less than 90 deg. and the end of said fusible element remote from said eutectic solder joint being conductively connected to said screw shell.

7. A plug type fuse as specified in claim 1 wherein said strip-like spring is arcuately shaped, and spring having a center of curvature situated at the side thereof where the longitudinal axis of said glass body is located.

8. A plug type fuse as specified in claim 7 wherein said spring and said fusible element enclose an angle of approximately 90°.

* * * * *